US008726536B2

(12) United States Patent
Shun et al.

(10) Patent No.: US 8,726,536 B2
(45) Date of Patent: May 20, 2014

(54) FLUIDIZED BED DRYING APPARATUS

(75) Inventors: Do Won Shun, Daejeon (KR); Chang Keun Yi, Daejeon (KR); Gyong Tae Jin, Daejeon (KR); Sung Ho Cho, Daejeon (KR); Jae Hyeon Park, Daejeon (KR); Dal Hee Bae, Daejeon (KR); Ho Jung Ryu, Daejeon (KR); Young Cheol Park, Daejeon (KR); Seung Yong Lee, Daejeon (KR); Si Hyun Lee, Daejeon (KR)

(73) Assignee: Korea Institute of Energy Research, Daejeon (KR)

( * ) Notice: Subject to any disclaimer, the term of this patent is extended or adjusted under 35 U.S.C. 154(b) by 894 days.

(21) Appl. No.: 12/901,105

(22) Filed: Oct. 8, 2010

(65) Prior Publication Data

US 2011/0247232 A1 Oct. 13, 2011

(30) Foreign Application Priority Data

Oct. 8, 2009 (KR) ..... 10-2009-0095606

(51) Int. Cl.
*F26B 3/08* (2006.01)
*F26B 17/00* (2006.01)

(52) U.S. Cl.
USPC ..... 34/364; 34/579; 34/588

(58) Field of Classification Search
CPC ..... F26B 3/00; F26B 3/08; B01J 2/16; B01J 8/18; B01J 8/24; B01J 8/44; F23C 7/00; F23C 9/00
USPC ..... 34/359, 360, 364, 379, 402, 443, 538, 34/579, 588, 209–211, 82, 218; 110/243–245
See application file for complete search history.

*Primary Examiner* — Kenneth Rinehart
*Assistant Examiner* — John McCormack
(74) *Attorney, Agent, or Firm* — Fox Rothschild, LLP

(57) ABSTRACT

An apparatus for drying particles in a fluidized state includes a particle input segment into which wet particles are input, a drying segment having a multi-perforated plate dividing an inner space of the drying segment into an upper section and a lower section, a plurality of upper partition plates partitioning the upper section and positioned above the multi-perforated plate, a plurality of lower partition plates in the lower section respectively corresponding to the plurality of upper partition plates, a plurality of pairs of channel plates in the lower section that pass through the multi-perforated plate such that each pair of the plurality of pairs of channel plates are respectively arranged on opposite sides of respective ones of the plurality of upper partition plates and on opposite sides of respective ones of the plurality of lower partition plates; and a heated-air flow supply segment for supplying hot gas to the drying segment.

20 Claims, 3 Drawing Sheets

FLUIDIZED BED DRYING APPARATUS

This invention claims the benefit of Korean Patent Application No. 10-2009-0095606 filed in Korea on Oct. 8, 2009, which is hereby incorporated by reference in its entirety.

BACKGROUND OF THE INVENTION

1. Field of the Invention

Embodiments of the invention relate to a fluidized bed drying apparatus, and more particularly, to a fluidized bed drying apparatus in which target-particles containing moisture, such as brown coal, are exposed to gases having different temperatures and different flow velocities in specified areas of a drying segment to improve drying efficiency.

2. Description for the Related Art

Generally, a fluidized bed drying apparatus has been used for drying efficiently wet particles such as coal, brown coal, slag and limestone, etc., through contact with heated-air over a large area of the particles when the particles are in a state of floating in an upper section of a bed by upward heated-air flow supplied from a lower section of the bed. That is, particles in fluid-like state are floated over a bed of heated-air (or gas) such that the target-particles being dried are well contacted with the heated-air. The drying procedure heat transfer coefficient between the target-particles being dried and the heated-gas is large so that the target-particles are dried rapidly and evenly.

According to prior art fluidized bed drying apparatus, target-particles for being dried are fluidized only in one drying space or floated over one bed using a gas having one set temperature and one set velocity. Typically, the one set temperature and one set flow velocity of the gas for the large amount of heated air needed for the entire prior art fluidized bed drying apparatus is determined based upon what is presumed to be the biggest and wettest particle that will need to be dried. As a result, a large amount of heated air needs to be used to ensure gas-solid contact of the target-particles for being dried is sufficient enough for drying and that the particles fluid flow is sufficiently consistent for even drying of all the particles. Accordingly, a large amount of energy is wasted in the drying of the smaller and/or dryer particles.

SUMMARY OF THE INVENTION

Embodiments of the invention are proposed to solve the aforementioned drawbacks of the prior art, and one object of the invention relates to providing a fluidized bed drying apparatus wherein gases having different temperature and different flow velocities are supplied to a drying segment through several hot gas supply tubes, saving total energy amount required for drying target-particles for being dried.

Another object of the invention relates to providing a fluidized bed drying apparatus wherein a fluidized bed is formed through gas flows having different temperatures and different flow velocities supplied to the drying segment.

Another object of the invention relates to providing a fluidized bed drying apparatus wherein a flow direction of the particles is varied such that the flow direction of wetter particles is reversed.

To achieve the aforementioned objects a fluidized bed apparatus for drying is provided wherein target-particles for being dried are exposed to gases, which have different temperatures and different flow velocities, respectively, create a fluid flow having a varying flow direction for the target-particles being dried.

According to one embodiment of the invention, an apparatus for drying particles in a fluidized state includes a particle input segment into which wet particles are input, a drying segment having a multi-perforated plate dividing an inner space of the drying segment into an upper section and a lower section, a plurality of upper partition plates partitioning the upper section and positioned above the multi-perforated plate, a plurality of lower partition plates in the lower section respectively corresponding to the plurality of upper partition plates, a plurality of pairs of channel plates in the lower section that pass through the multi-perforated plate such that each pair of the plurality of pairs of channel plates are respectively arranged on opposite sides of respective ones of the plurality of upper partition plates and on opposite sides of respective ones of the plurality of lower partition plates; and a heated-air flow supply segment for supplying hot gas to the drying segment.

According to another embodiment of the invention, an apparatus for drying particles in a fluidized state includes a particle input segment into which wet particles are input, a drying segment having a multi-perforated plate dividing an inner space of the drying segment into an upper section and a lower section, a plurality of upper partition plates partitioning the upper section and spaced apart from the multi-perforated plate, a plurality of lower partition plates in the lower section respectively corresponding to the plurality of upper partition plates, a plurality of pairs of channel plates in the lower section that pass through the multi-perforated plate such that each pair of the plurality of pairs of channel plates are respectively arranged on opposite sides of respective ones of the plurality of upper partition plates and on opposite sides of respective ones of the plurality of lower partition plates, and a heated-air flow supply segment for supplying hot gas to the drying segment.

According to yet another embodiment of the invention, an apparatus for drying particles in a fluidized state includes a particle input segment into which wet particles are input, a drying segment having a multi-perforated plate dividing an inner space of the drying segment into an upper section and a lower section, a plurality of upper partition plates partitioning the upper section and spaced apart from the multi-perforated plate, a plurality of lower partition plates in the lower section respectively corresponding to the plurality of upper partition plates, a plurality of pairs of channel plates in the lower section that pass through the multi-perforated plate such that each pair of the plurality of pairs of channel plates are respectively arranged on opposite sides of respective ones of the plurality of upper partition plates and on opposite sides of respective ones of the plurality of lower partition plates, wherein channel spaces on both sides of each of the plurality of upper partition plates are defined between each of the plurality of upper partition plates and an adjacent pair of the plurality of pairs of channel plates above the multi-perforated plate and a tunnel is defined between adjacent channel spaces where each of the plurality of upper partition plates is spaced apart from the multi-perforated plate and a heated-air flow supply segment for separately supplying a gas having different temperatures and different flow velocities to the channel spaces.

It is to be understood that both the foregoing general description and the following detailed description are exemplary and explanatory and are intended to provide further explanation of embodiments of the invention as claimed.

DETAILED DESCRIPTION OF THE PREFERRED EMBODIMENTS

The preferred embodiments of a fluidized bed drying apparatus will be described in detail referring to the accompanied drawings. However, it has to be understood that embodiments of the invention are not limited to the preferred embodiments described hereafter.

Figure 1:
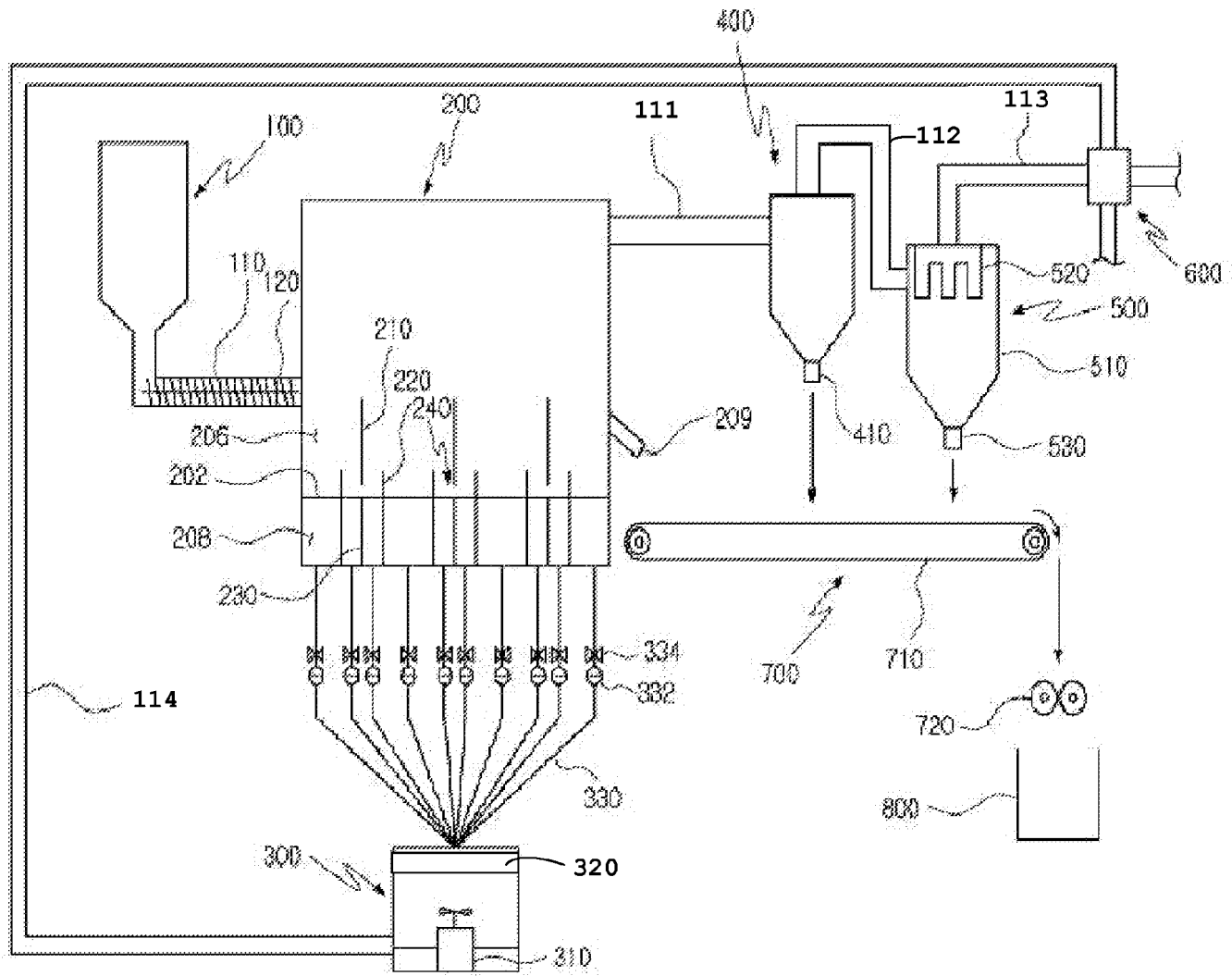
FIG. 1 is a sectional view of a fluidized bed drying apparatus according an embodiment of the invention.

FIG. 1 is a sectional view of a fluidized bed drying apparatus according to an embodiment of the invention. As shown in FIG. 1, a fluidized bed drying apparatus according to a preferred embodiment of the invention includes: a particle input segment 100 into which wet particles are input; a drying segment 200 for blowing hot gas to efficiently dry the wet particles from the particle input segment; a heated-air flow supplying segment 300 for supplying hot gas to the drying segment 200; a dust collecting segment 400 for collecting powder particles contained in gas being discharged from the drying segment 200; a filtering segment 500 for filtering out powder particles contained in the gas being discharged from the dust collecting segment 400; a heat exchanging segment 600 for exchanging heat with external gas and supplying it to the heated-air flow supplying segment 300; and a pelletizing segment 700 for compressing powder particles being discharged from the drying segment 200, the dust collecting segment 400 and the filtering segment 500 into a pellet form.

The particle input segment 100 is configured such that an upper part has a cylindrical shape with a constant diameter and a lower part shaped as a funnel connected to a transfer tube 110. The particle input segment 100 is provided for inputting wet target-particles to be dried, such as brown coal containing moisture. The particle input segment 100 is connected to a drying segment 200 via a transfer tube 110. A transfer screw 120 for supplying the wet particles to the drying segment 200 is provided inside the transfer tube 110. That is, the wet particles being inputted are transferred by the transfer screw 120 and then gravity poured into the drying segment 200 at the end of the transfer tube 110. Alternatively, a conveyor system may be provided for conveying the wet particles into the drying segment 200 instead of the transfer screw 120.

Figure 2:
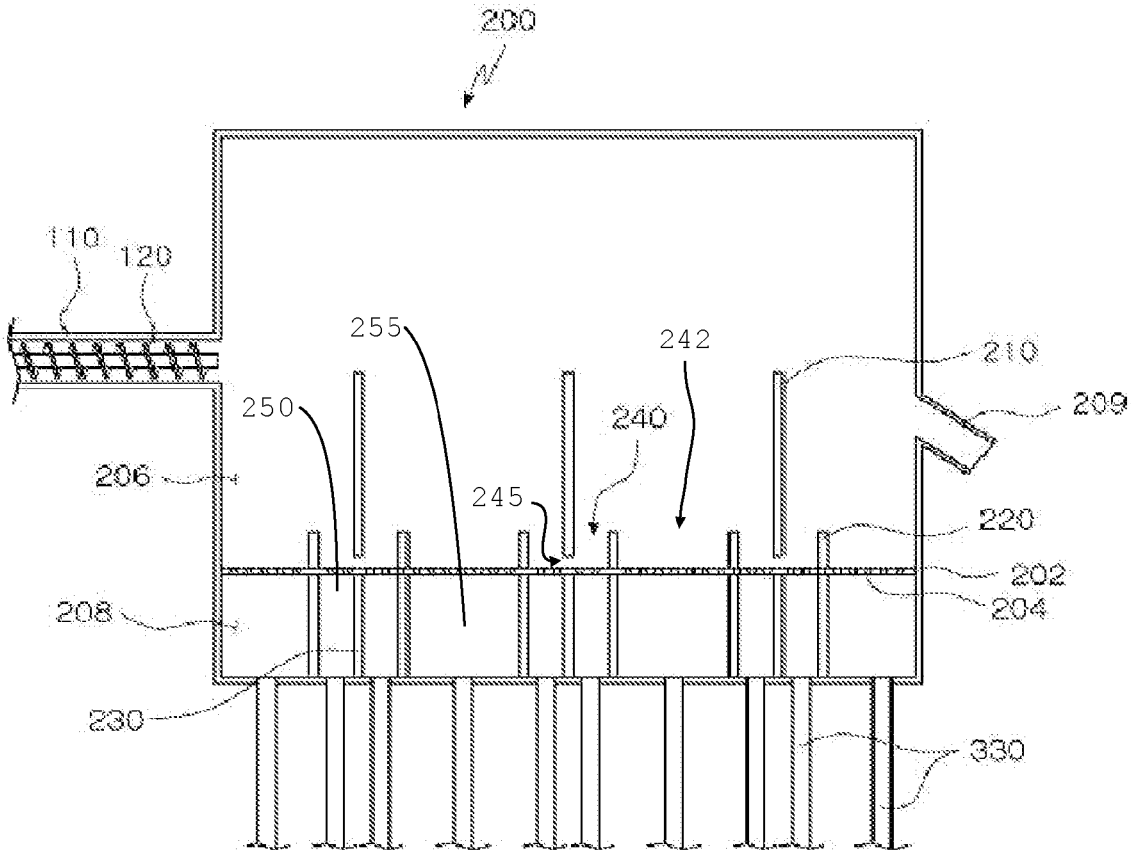
FIG. 2 is a sectional view of a drying segment provided in the fluidized bed drying apparatus according to an embodiment of the invention.

FIG. 2 is a sectional view of a drying segment provided in the fluidized bed drying apparatus according to an embodiment of the invention. As shown in FIG. 2, the drying segment 200 has an inner space divided into an upper section 206 and a lower section 208 by a multi-perforated plate 202. The transfer tube 110 of the particle input segment 100 is connected to the upper space 206 at one end of the drying segment 200. A discharging port 209 is at the other end of the upper section 206 of the drying segment 200 for discharging dried particles to the compression segment 700 through pressure difference between the inside of the drying segment 200 and the outside of the discharging port 209.

A plurality of through-holes 204 for gas to pass through are provided in the multi-perforated plate 202. A plurality of upper partition plates 210 in the upper section 206, which are spaced apart from the multi-perforated plate 202 and are arranged perpendicularly with respect to the multi-perforated plate 202, partition the upper section 206. A plurality of lower partition plates 230 in the lower section 208 respectively corresponding to the plurality of upper partition plates 210. Each of the lower partition plates 230 extends to the multi-perforated plate 202 and is arranged perpendicularly to the multi-perforated plate 202 so as to partition the lower section 208 like the plurality of upper partition plates 210 partitions the upper section 206. In addition, a plurality of pairs of channel plates 220 are provided in the lower section 208 and pass through the multi-perforated plate 202 so that each pair of the plurality of pairs of channel plates 220 are respectively arranged on opposite sides of respective ones of plurality of upper partition plates 210 and on opposite sides of respective ones of plurality of lower partition plates 230.

The spaces between each of the upper partition plates 210 and an adjacent pair of the plurality of pairs of channel plates 220 above the multi-perforated plate 202, form channel spaces 240 on both sides of each of the plurality of upper partition plates 210, as shown in FIG. 2. The plurality of upper partition plates 210 are spaced apart from the multi-perforated plate 202A such that tunnels 245 are formed between adjacent channel spaces 220. The spaces between the plurality of pairs of channel plates 220, and between one channel plate of a pair of the plurality of pairs of channel plates 220 and a wall of the drying segment 220, above the multi-perforated plate 202, form floating areas 242. The plurality of upper partition plates 210 are spaced apart from the multi-perforated plate 202A such that tunnels 245 are formed between adjacent channel spaces 220.

The lower section 208, located below the multi-perforated plate 202, contains several pressure chambers formed by walls of the channel plates 220, the lower partition plate 230 or outside walls of the drying chamber 200. Each of the pressure chambers between a channel plate 220 and a lower partition plate 230 is a channel chamber 250. Each of the pressure chambers between a pair of channel plates 220 or between a channel plate 220 and a wall of the drying segment 200 is a suspension chamber 255. Hot gas is blown into the channel chambers 250 and suspension chambers 255 by heated-air supply tubes 330 respectively connected to each of the channel chambers 250 and suspension chambers 255. The hot gas blown into the channel chambers 250 and suspension chambers 255 is discharged through the multi-perforated plate 202 into the channel spaces 240 and floating areas 242.

As shown in FIG. 1, a heated-air flow supply segment 300 is provided for supplying hot gases of different flow velocities and different temperatures to the drying segment 200. An air blower 310 provides gas for use at a variety of velocities. The air blower 310 can include an air pre-heater heater 320. In the alternative, a conventional air blower and pre-heater can be used according to embodiments of the invention. The gas provided by the air blower 310 and pre-heated by the air pre-heater 320 is supplied to the heated-air supply tubes 330. Each of the heated-air supply tubes 330 can have a separate heater 332 and valves 334 so as to supply hot gases of different temperatures and different flow velocities to the channel chambers 250 and suspension chambers 255 in the lower section 208. The heated-air supply tubes 330 provide gas to the channel spaces 240 and the floating areas 242, respectively. The hot gas, which is supplied from the air blower 310, is heated by a heater 332 provided on the respective heated-air supply tube 330 and a flow velocity thereof is controlled by the valve 334, such that gases at different temperatures and flow velocities are supplied to the respective channel spaces 240 and respective floating areas 242.

Figure 3:
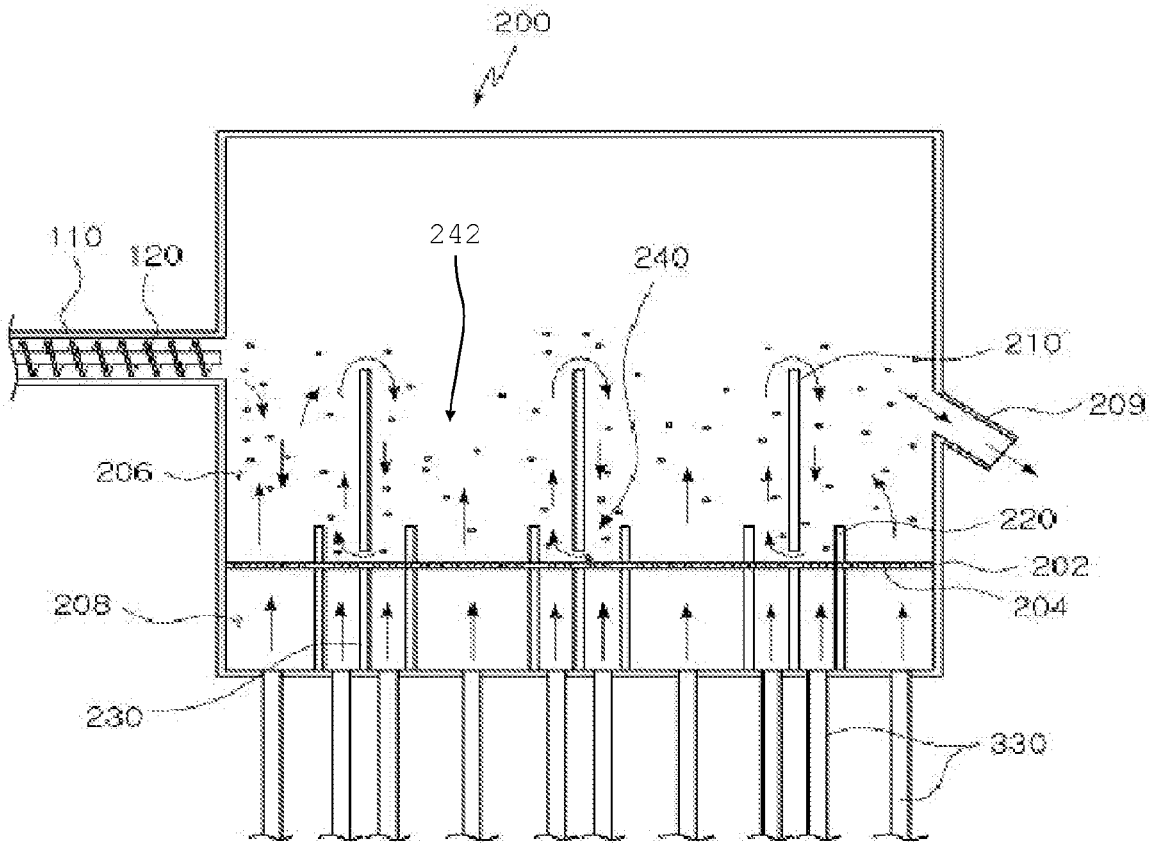
FIG. 3 is a sectional view showing a fluidized bed of particles in the drying segment of the fluidized bed drying apparatus according to an embodiment of the invention.

FIG. 3 is a sectional view showing a fluidized bed of particles in the drying segment of the fluidized bed drying apparatus according to an embodiment of the invention. The drying segment 200 floats the wet particles being supplied from the particle input segment 100 with hot gas blown upward from the heated-air supply segment 300 through a control valves 334 to form a fluidized bed of particles in the upper section 206 of the drying segment 200, as shown in FIG. 3. The fluidized bed of particles allows the wet particles to be surrounded by dry hot gas in space such the wet particles are dried through heat exchange between hot gas and the wet particles. A hot gas flow containing particles can pass through the tunnels 245 between each of the plurality of upper partition plates 210 and the multi-perforated plate 202 above each of the plurality of lower partition plates 230, as shown in FIG. 3.

The dust collecting segment 400 is provided for collecting powder particles contained in the gas discharged from the drying segment 200, which is connected to the upper section 206 via an evacuation tube 111. The dust collecting segment 400 uses a cyclone effect for separating solid particles and further comprises a dust collecting tank and a dust collecting filter, etc., for collecting fine powder particles contained in the gas. In the alternative, a conventional configuration may be adopted as the dust collecting segment 400 according to embodiments of the invention, and thus a detailed description thereof is omitted. A dust collecting discharge port 410 can be provided on a lower part of the dust collecting segment for discharging the collected powder particles to a compression segment 700. Thus, the dust collecting segment 400 can be used for separating out the powder particles contained in the discharging gas produced when drying wet particles and then discharging the powder particles to the compression segment 700 through the dust collecting discharge port 410 such that powder particles are removed by a filtering segment 500, which will be described below.

The filtering segment 500 is provided for filtering out powder particles contained in the gas discharged from the dust collecting segment 400. The dust collecting segment 400 is connected to the filtering segment 500 via the dust transfer tube 112. The filtering segment 500 has a filtering tank 510 into which the gas discharged from the dust collecting segment 400 is received, and a filter 520 for filtering out powder particles so as to receive the powder particles in the filtering tank 510. Additionally, a filter discharging port 530 for discharging the received powder particles to the compression segment 700 is provided on the lower side of the filtering tank 510. Thus, the gas discharged from the dust collecting segment 400 is received into the filtering tank 510 and the powder particles contained in the gas is filtered out by the filter 520 and then the powder particles are discharged onto the compression segment 700 through the filter discharging port 530.

The heat exchanging segment 600 provides heat from the used gas into the incoming fresh gas for the heated-air flow supply segment 300. The heat exchanging segment 600 is connected to the heated-air flow supply segment 300 via the heat transfer tube 113. Thus, the heat exchange segment 600 receives external fresh gas having lower temperature and increases temperature of the external gas through heat exchange from the used gas to the external gas. The heat exchange segment may further include a supplementary heater and a fan, etc., for supplying the external air, which is also heated in addition to the heating through heat exchange with the used gas. Alternatively, a conventional configuration thereof may be used for the heat exchange segment 600 according embodiments of the invention and thus detailed description thereof is omitted.

The compression segment 700 is provided for compressing dried particles and powder from the drying segment 200, the dust collection segment 400 and the filtering segment 500 as pellets. The compression segment 700 can also include a transfer conveyor 710 for conveying the dried particles and powder discharged therefrom in one direction, and a compression roller 720 rotated as a pair to compress the dried particles and powder. The particles produced as pellets through the compression segment 700 are received into a storage tank 800.

Hereinafter, an operation of the fluidized bed apparatus configured in an aforementioned way according to embodiments of the invention will be described.

First, the air blower 310 of the heated-air flow supply segment 300 is operated to blow air while the air is heated by the pre-heater 320 and then heated-air flow is supplied to the respective heated air flow supply tubes 330. At this time, the discharged gas which is heat-exchanged through the heat exchange segment 600 is added to the heated air flow. Since the heaters 332 for additionally heating the pre-heated air and the valve 334 for controlling a flow velocity thereof can each be controlled separately, the heated-air which is discharged from the respective heated air flow supply tubes 330 may have different temperatures and different flow velocities, respectively, and be supplied to the channel spaces 240 and floating areas 242 of the upper section 206 at different conditions of temperature and different flow velocities.

Meanwhile, target-wet particles for being dried are supplied into the drying segment 200 from the particle input segment 100 through the transfer tube 110 with a help of the transfer screw 120. Since the outlet of the transfer tube 110 is in the upper section 206 of the drying segment 200, the wet particles for being dried are dropped in by gravity and then floated by the gas flow inside the drying segment 200. The overall gas flow incurred in the upper section 206 of the drying segment 200 is such that particles move from the outlet of the transfer tube 110 to the discharging port 209, which is placed on lower side of the drying segment, as shown in FIG. 3.

Referring to a drying procedure of wet particles in the lower part of the upper section 206, the particles in the gas flow are dried in the channel spaces 240 and the floating areas 242 throughout the overall drying segment 200 with the gases having a different temperatures and different flow velocities by being moved in a sequence across the channel spaces 240 and the floating areas 242 while in a fluidized bed, and finally are discharged at the discharging port 209. While some wet particles are transferred sequentially from a previous channel space 240 to a subsequent channel space 240 in a fluidized state over an upper partition plate 210, other dried particles are reverse flowed through the tunnel 245 between the upper partition plates 210 and the multi-perforated plate 202 back toward less dried particles in the previous channel. The reverse flow of particles is caused by a gas flow through the tunnel 245 due to the gases in a previous channel space 240 and a subsequent channel space 240 having a different temperature and different flow velocities.

The particles reverse flowed through the tunnel 245 toward less dried particles in the previous channel break apart clustered groups of wet particles, improving fluidity or fluidization properties of the particle flow. In other words, when gas having a weaker flow velocity is supplied to one side of the channel space 240 (referring to right side of the upper partition plate 210 in FIG. 3) and gas having stronger flow velocity is supplied to the other side of the channel space 240 (referring to left side of the upper partition place 210 in FIG. 3), some of the particles dried in the fluid flow of the one side of the channel space 240 are reverse flowed (right to left) through the tunnel 245 below the upper partition plate 210 with gas flow having stronger flow velocity and ascend to break apart clusters of wet particles staying on the other side of the upper partition plate 210, improving a contact ratio of the particles with gas and fluidity thereof.

When various gases having a different temperature and different flow velocities, respectively, are supplied to the respective channel space 240 and flow areas 242 inside the drying segment 200 by controlling the heaters 332 and valves 334 provided on the respective heated air flow supply tube 330, some dried particles are transferred opposite to the flow direction of the fluidized bed through a tunnel 245 between the upper partition plate 210 and the multi-perforated plate 202 so as to break apart clusters of wet particles, improving fluidity of the particles and contact rate of particles with the gas. The wet particles supplied to the drying segment 200 are dried at a predetermined level in the channel space 240 by the gas having a different temperature and flow velocity and then transferred between channel spaces 240 in a fluidized bed. The particles reverse flowed opposite to the flow direction by flow velocity differences of the gas improve fluidity of the overall flow and increase contact area of the particle with the gas for better drying efficiency.

A description of the entire particle movement and flow directions, including particle movement on lower part of the drying segment 200 through the tunnel 245 due to hot gases having different temperature and different flow velocities in adjacent channel spaces 240, will now be described. The hot gas in one channel space has a higher flow velocity than the hot gas in an adjacent channel space. More particularly, some of the particles floated in the drying segment 200 and being effected by gravity are moved from right channel space to left channel space through a tunnel 245 between a lower partition plate 230 and the upper partition plate 210 and then rises on the ascending flow on left side of the upper partition plate 210 and circulated over the upper partition plate 210. A portion of the particles can then again descend on the right side of the upper partition plate 210 to transfer through the tunnel channel from right side to left side and join with the left side. Here, the left side ascending particles collide with particles which are floated and remaining on the upper section 206 of the drying segment 200 and impact the particles to be broken down as more fine particles. As a result, the wet particles floating on the upper section 206 of the drying segment 200 can be divided more fine particles and dried more efficiently.

The discharging gas after drying the wet particles in the drying segment 200 is discharged to the dust collecting segment 400 through the transfer tube 110. The gas discharged to the dust collecting segment 400 is received into a dust collecting tank and particles separated through a dust collecting filter and then powders are discharged to a compression segment 700 through a dust collecting discharging port 410 and the gas with fine powder is discharged to a filter segment 500 through the transfer tube 110. Meanwhile, fine powder contained in the gas discharged from the dust collecting segment 400 is supplied to the filter segment 500, and received in the filtering tank 510 and simultaneously filtered through the filter 520, and then discharged to the compression segment 700 through the filter discharging port 530. In addition, the heat exchange segment 600 receives external gas and then heat-exchanges with the gas after being dried which is then discharged. As a result, the external gas is heated to raise temperature and is supplied to the heated-air flow supply segment 300. Meanwhile, the dried particles and powder discharged through the drying segment 200, the dust collecting segment 400 and the filtering segment 500 are supplied to a compression roller 720 by a transfer conveyor 710 of the compression segment 700 and then compressed as pellet form and received into a storage tank 800.

While embodiments of the invention are described referring to the preferred embodiments, the invention is not limited thereto, and thus various variation and modification can be made without departing from a scope of the invention.

What is claimed is:

1. An apparatus for drying particles in a fluidized state, comprising:

a particle input segment into which wet particles are input;

a drying segment including:

a multi-perforated plate dividing an inner space of the drying segment into an upper section and a lower section;

a plurality of upper partition plates partitioning the upper section and positioned above the multi-perforated plate;

a plurality of lower partition plates in the lower section respectively corresponding to the plurality of upper partition plates;

a plurality of pairs of channel plates in the lower section that pass through the multi-perforated plate such that each pair of the plurality of pairs of channel plates are respectively arranged on opposite sides of respective ones of the plurality of upper partition plates and on opposite sides of respective ones of the plurality of lower partition plates; and a heated-air flow supply segment for supplying hot gas to the drying segment.

2. An apparatus for drying particles according to claim 1, further comprising:

a dust collecting segment for separating particles contained in gas, which is discharged from the drying segment;

a filtering segment for filtering fine powder contained in the gas discharged from the dust collection segment;

a heat exchanging segment for exchanging heat with external gas and supplying to the heated-air flow supplying segment; and a compressing segment for compressing particles and powder which are discharged from the drying segment, the dust collecting segment and the filtering segment into pellet form.

3. An apparatus for drying particles according to claim 1, wherein a plurality of channel spaces on both sides of each of the plurality of upper partition plates are defined between each of the plurality of upper partition plates and an adjacent pair of the plurality of pairs of channel plates above the multi-perforated plate.

4. An apparatus for drying particles according to claim 3, wherein and plurality of upper partition plates are spaced apart from the multi-perforated plate such that a plurality of tunnels are formed between adjacent ones of the plurality of channel spaces.

5. An apparatus for drying particles according to claim 3, wherein, floating areas are disposed above the multi-perforated plate and between the plurality of pairs of channel plates, and between one channel plate of a pair of the plurality of pairs of channel plates and a wall of the drying segment.

6. An apparatus for drying particles according to claim 4, further comprising;

a plurality of heated-air flow supply tubes from the heated-air flow supply segment connected to the drying segment for respectively providing a predetermined heated-air flows to the plurality of channel spaces.

7. An apparatus for drying particles according to claim 6, further comprising;

a plurality of control valves respectively provided in each of the plurality of heated air flow supply tubes;

a plurality of heater segments respectively provided in each of the plurality of heated air flow supply tubes, wherein gases having different temperatures and different flow velocities can be separately supplied to the channel spaces.

8. An apparatus for drying particles in a fluidized state, comprising:

a particle input segment into which wet particles are input;

a drying segment including:

a multi-perforated plate dividing an inner space of the drying segment into an upper section and a lower section;

a plurality of upper partition plates partitioning the upper section and spaced apart from the multi-perforated plate;

a plurality of lower partition plates in the lower section respectively corresponding to the plurality of upper partition plates;

a plurality of pairs of channel plates in the lower section that pass through the multi-perforated plate such that each pair of the plurality of pairs of channel plates are respectively arranged on opposite sides of respective ones of the plurality of upper partition plates and on opposite sides of respective ones of the plurality of lower partition plates; and a heated-air flow supply segment for supplying hot gas to the drying segment.

9. An apparatus for drying particles according to claim 8, further comprising:

a dust collecting segment for separating particles contained in gas which is discharged from the drying segment;

a filtering segment for filtering fine powder contained in the gas discharged from the dust collection segment;

a heat exchanging segment for exchanging heat with external gas and supplying to the heated-air flow supplying segment; and a compressing segment for compressing particles and powder which are discharged from the drying segment, the dust collecting segment and the filtering segment into pellet form.

10. An apparatus for drying particles according to claim 8, wherein a plurality of channel spaces on both sides of each of the plurality of upper partition plates are defined between each of the plurality of upper partition plates and an adjacent pair of the plurality of pairs of channel plates above the multi-perforated plate.

11. An apparatus for drying particles according to claim 10, further comprising;

a plurality of heated-air flow supply tubes from the heated-air flow supply segment connected to the drying segment for respectively providing a predetermined heated-air flows to the channel spaces.

12. An apparatus for drying particles according to claim 11, further comprising;

a plurality of control valves respectively provided in each of the plurality of heated air flow supply tubes;

a plurality of heater segments respectively provided in each of the plurality of heated air flow supply tubes, wherein gases having different temperatures and different flow velocities can be separately supplied to the channel spaces.

13. An apparatus for drying particles according to claim 8, wherein, a plurality of floating areas are disposed above the multi-perforated plate and between the plurality of pairs of channel plates, and between one of a pair of the plurality of pairs of channel plates and a wall of the drying segment.

14. An apparatus for drying particles according to claim 13, further comprising;

a plurality of heated-air flow supply tubes from the heated-air flow supply segment connected to the drying segment for respectively providing a predetermined heated-air flows to the channel spaces and the floating areas.

15. An apparatus for drying particles according to claim 14, further comprising;

a plurality of control valves respectively provided in each of the plurality of heated air flow supply tubes;

a plurality of heater segments respectively provided in each of the plurality of heated air flow supply tubes, wherein gases having different temperatures and different flow velocities can be separately supplied to the plural channel spaces and the floating areas.

16. An apparatus for drying particles in a fluidized state, comprising:

a particle input segment into which wet particles are input;

a drying segment including:

a multi-perforated plate dividing an inner space of the drying segment into an upper section and a lower section;

a plurality of upper partition plates partitioning the upper section and spaced apart from the multi-perforated plate;

a plurality of lower partition plates in the lower section respectively corresponding to the plurality of upper partition plates;

a plurality of pairs of channel plates in the lower section that pass through the multi-perforated plate such that each pair of the plurality of pairs of channel plates are respectively arranged on opposite sides of respective ones of the plurality of upper partition plates and on opposite sides of respective ones of the plurality of lower partition plates, wherein channel spaces on both sides of each of the plurality of upper partition plates are defined between each of the plurality of upper partition plates and an adjacent pair of the plurality of pairs of channel plates above the multi-perforated plate and a tunnel is defined between adjacent channel spaces where each of the plurality of upper partition plates is spaced apart from the multi-perforated plate; and a heated-air flow supply segment for separately supplying a gas having different temperatures and different flow velocities to the channel spaces.

17. An apparatus for drying particles according to claim 16, further comprising:

a dust collecting segment for separating particle powder contained in gas which is discharged from the drying segment;

a filtering segment for filtering fine powder of the particle contained in the gas discharged from the dust collection segment;

a heat exchanging segment for exchanging heat with external gas and supplying to the heated-air flow supplying segment; and a compressing segment for compressing particles and powder which are discharged from the drying segment, the dust collecting segment and the filtering segment into pellet form.

18. An apparatus for drying particles according to claim 16, further comprising:

a plurality of air flow supply tubes from the heated-air flow supply segment connected to the drying segment for respectively providing a predetermined heated-air flows to the channel spaces;

a plurality of control valves respectively provided in each of the plurality of heated air flow supply tubes;

a plurality of heater segments respectively provided in each of the plurality of heated air flow supply tubes, wherein gases having different temperatures and different flow velocities can be separately supplied to the channel spaces.

19. An apparatus for drying particles according to claim 16, wherein floating areas are defined above the multi-perforated plate and between the plurality of pairs of channel plates, and between one of a pair of the plurality of pairs of channel plates and a wall of the drying segment.

20. An apparatus for drying particles according to claim 19, further comprising;

air flow supply tubes from the heated-air flow supply segment connected to the drying segment for respectively providing a predetermined heated-air flows to the channel spaces and the floating areas;

a plurality of control valves respectively provided in each of the plurality of heated air flow supply tubes;

a plurality of heater segments respectively provided in each of the plurality of heated air flow supply tubes, wherein gas having different temperatures and different flow velocities can be separately supplied to the channel spaces and the floating areas.

* * * * *